United States Patent [19]

Donaldson

[11] 4,362,267

[45] Dec. 7, 1982

[54] MAIL BOX TRAY

[76] Inventor: Homer A. Donaldson, 3475 Wisner Hwy., Adrian, Mich. 49221

[21] Appl. No.: 196,737

[22] Filed: Oct. 14, 1980

[51] Int. Cl.[3] ..... B65D 91/00

[52] U.S. Cl. ..... 232/17; 232/33

[58] Field of Search ..... 232/17, 33, 38

[56] References Cited

U.S. PATENT DOCUMENTS

| | | | |
|---|---|---|---|
| 838,194 | 12/1906 | Larsh | 232/33 |
| 908,543 | 1/1909 | Brown | 232/17 |
| 1,139,491 | 5/1915 | Coon | 232/33 |
| 1,471,899 | 10/1923 | Koenig | 232/17 |
| 2,068,275 | 1/1937 | Luss | 232/33 |
| 2,781,964 | 2/1957 | Ledgerwood | 232/17 |
| 2,804,263 | 8/1957 | Fonde | 232/17 X |
| 2,868,444 | 1/1959 | Whittier | 232/33 X |
| 3,515,337 | 6/1970 | Bornus | 232/33 |
| 4,160,520 | 7/1979 | Cluthé | 232/17 |

*Primary Examiner*—Roy D. Frazier
*Assistant Examiner*—Peter A. Aschenbrenner
*Attorney, Agent, or Firm*—Beaman & Beaman

[57] ABSTRACT

A tray for mail boxes, especially those of the rural type, wherein the tray rests upon the mail box bottom and receives mail and other contents placed within the mail box. The tray includes finger grasping means adjacent the mail box door whereby the tray may be partially pulled from the box making the contents readily accessible and eliminating the necessity to reach deeply into the mail box cavity. Means are defined on the tray for holding letters to be picked up in a convenient position, and for supporting coins to pay postage due.

3 Claims, 5 Drawing Figures

MAIL BOX TRAY

BACKGROUND OF THE INVENTION

Mail boxes of the type commonly used on rural routes define elongated cavities of such depth as to accomodate newspapers and packages, and are of a depth considerably greater than the dimension of most letters and conventional mail. Accordingly, when the mail box contents are being placed therein it is common for the mail to be deposited adjacent the mail box rear wall if the carrier placed the mail in the box with a forward motion. To retrieve the contents it is necessary to reach deeply into the box, which is particularly difficult from within an automobile. It is necessary to reach the distance between the automobile and box, and reach into the mail box cavity, and small mail pieces such as post cards can be easily overlooked.

Further, it is common for wasp, hornets and bees to frequent mail boxes, and to reach deeply into the box may subject the user to the likelihood of harm.

It is an object of the invention to provide a tray for mail boxes whereby the tray may be partially pulled from the mail box facilitating the removal of the box contents and permitting all mail pieces, regardless of size, to be readily removed without undue exertion or contortion.

An additional object of the invention is to provide a mail box tray which is of an economical construction, effectively receives and holds the mail box contents, and is easily operated.

Another object of the invention is to provide a tray for mail boxes wherein the tray includes means for holding letters to be collected in an obvious and accessible manner, and also to provide means for holding coins for payment of postage.

In the practice of the invention the tray is of a plan configuration substantially corresponding to the shape of the mail box bottom. The tray includes walls at its front, rear and lateral edges, the front edge constituting a finger gripping member and of relatively low vertical height so as not to interfere with viewing of the mail box interior, or access thereto, and the side and rear wall are of such vertical dimension as to effectively retain tray contents during movement of the tray.

An elongated ridge defines an abutment on the bottom panel of the tray which serves to position envelopes to be collected, and another ridge disposed adjacent to the tray front edge defines a coin receiving slot.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
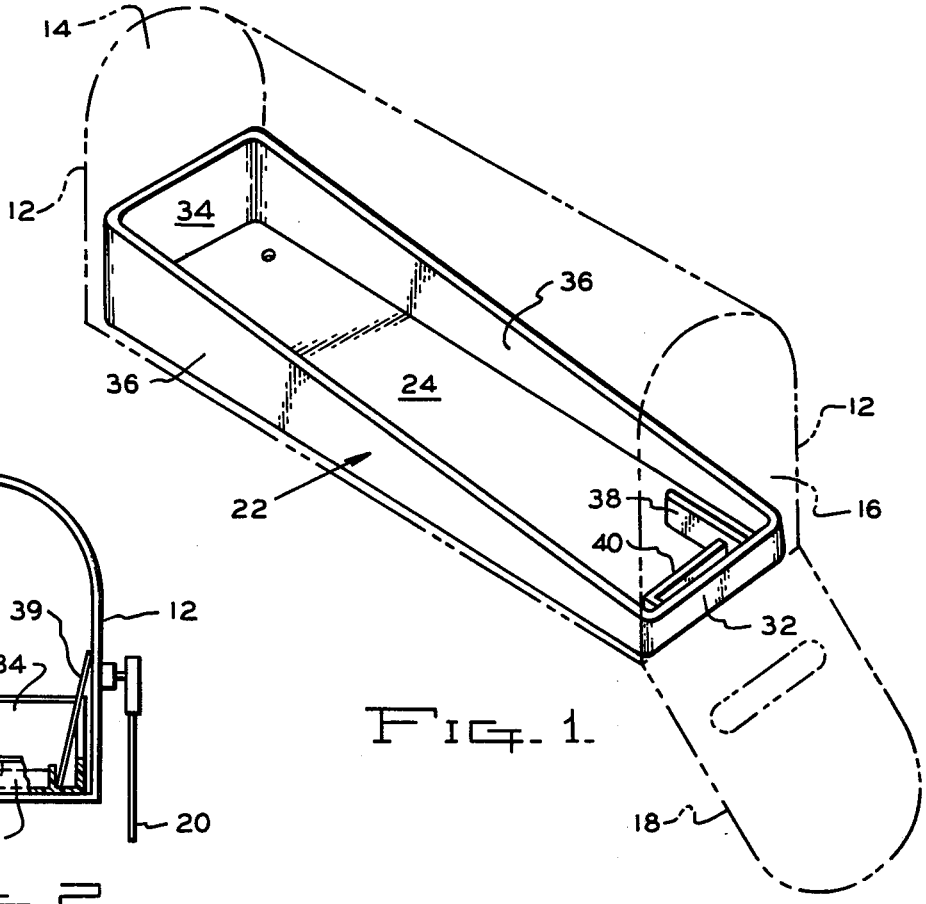
FIG. 1 is a perspective view of a mail box tray in accord with the invention, the mail box being illustrated in dotted lines.
Figure 2:
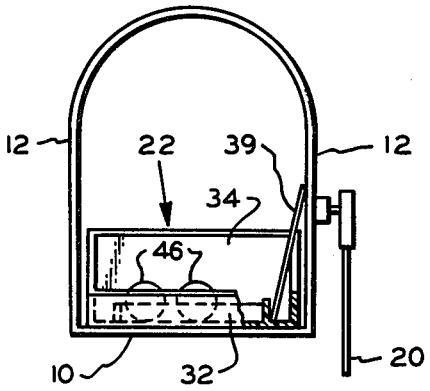
FIG. 2 is a front elevational view of a mail box and tray, the mail box door being removed for purpose of illustration.

With reference to FIGS. 1 and 2, the type of mail box with which the tray of the invention is employed is the conventional type widely used on rural mail routes. The box consists of a bottom panel 10, FIG. 2, from which arise vertical side walls 12 blending into a convex roof portion. The box includes a rear wall 14, and at its front end an access opening is defined at 16. The access opening is selectively closed by a door 18 pivoted to the front edge of the bottom 10. Usually, an indicating flag 20 is mounted upon a side wall to indicate to the mail carrier that the box contains a letter to be collected.

The mail box tray in accord with the invention is preferably formed of a molded synthetic plastic material, all of the components of the tray being of a homogeneous construction simultaneously formed during molding. The tray 22 includes a bottom panel 24 of rectangular plan configuration, FIG. 3, having a front edge 26, a rear edge 28, and lateral sides 30. A front wall 32 extends vertically upward from the front edge 26, and a rear wall 34 extends vertically from rear edge 28. Likewise, the lateral side walls 36 extend vertically from the tray lateral sides 30, and it will be appreciated that the upper edge of the rear wall 34 is a greater dimension from the bottom panel 24 than is the upper edge of wall 32 whereby the upper surface of the side walls 36 inclines uniformly upwardly from the front wall to the rear wall. The upper wall edges of the side walls 36 merge with the upper edge of the front wall, and the upper edge of the rear wall.

An elongated ridge 38 is homogeneously defined from the bottom panel 24 and extends vertically upwardly therefrom spaced from an adjacent side wall 36, and parallel thereto. This ridge constitutes an abutment for positioning the lower edge of an envelope 39, or envelopes, placed within the tray which lean against the inside wall of the box wherein letters to be collected by the carrier will be held in a conveniently accessible position, and readily observed by the carrier, FIG. 2.

Figure 3:
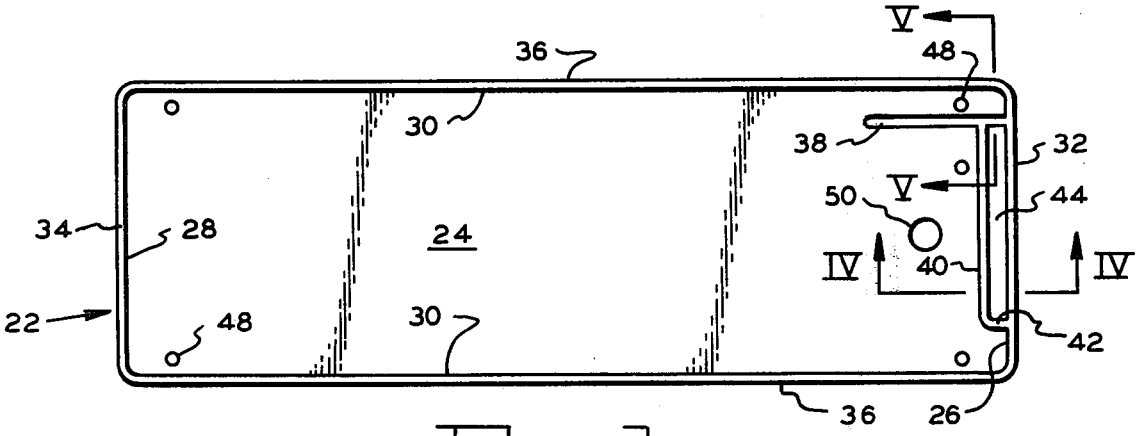
FIG. 3 is a plan view of the tray, per se.
Figure 4:
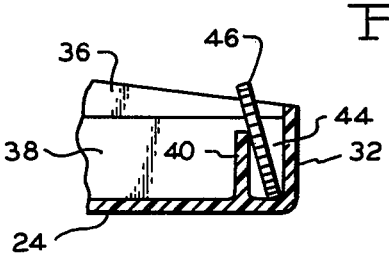
FIG. 4 is an elevational, detail, sectional view taken along Section IV—IV of FIG. 3 illustrating a coin in position.
Figure 5:
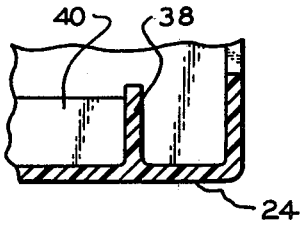
FIG. 5 is a detail, enlarged, elevational, sectional view as taken along Section V—V of FIG. 3.

Further, an elongated ridge 40 is defined spaced from and parallel to the front wall 32, arising from the bottom panel 24 and includes a portion 42 attached to the front wall, FIG. 3, whereby a coin receiving slot 44 is defined between the ridge 40 and the front wall 32 for receiving coins 46 to cover the postage of mail which is to be collected by the carrier, in the event the mail is not properly stamped.

The tray 22 is of a length slightly less than the length of the mail box panel 10 whereby the tray is placed upon the mail box panel 10 as shown in FIGS. 1 and 2, and the door 18 may be closed in the normal manner. When the carrier desires to place the mail within the box access to the mail box cavity is not adversely hindered by the front wall 32 as the front wall is of low height, usually less than 1", and the mail deposited within the mail box will be received within the tray. As the width of the tray is slightly less then the width separating the mail box walls 12 there is little likelihood that all mail deposited within the box will not be received within the tray.

When the user desires to empty the mail box the box cover 18 is opened, and the user grasps the front wall 32 and partially slides the tray from the mail box cavity. This motion also translates the mail contents towards the box opening 16 rendering the same easily removable from the tray and eliminating the necessity for the user to reach into the box cavity. Of course, the further the tray 22 is pulled from the box, the lesser the distance the user needs to reach into the box, and the tray permits the mail box contents to be readily removed either from an automobile, or by a pedestrian.

Preferably, drain holes 48 are defined in the tray in the event water is received within the tray, and a large hole 50 is formed in the tray bottom which is used to support the tray during display in stores.

It wil be appreciated that the mail box tray of the invention permits the contents of the mail box to be readily removed without undue exertion or contortion, and the tray construction facilitates the collection of mail by the carrier, yet may be readily manufactured at a reasonable cost.

It is apparent that various modifications to the inventive concepts may be apparent to those skilled in the art without departing from the spirit and scope of the invention.

I claim:

1. A mail box tray for slidable support within a mail box to facilitate access to the mail box contents comprising, a tray body of a molded homogeneous synthetic plastic material having a bottom panel and lateral side walls, a front wall and a rear wall extending upwardly from said bottom panel, said rear wall having a greater vertical dimension than that of said front wall, said side walls intersecting said rear and front walls and having a vertical dimension at the intersection with said walls substantially corresponding to that of the intersected wall whereby the vertical dimension of said side walls decreases from said rear wall to said front wall, a first ridge homogeneously extending upwardly from said bottom panel in spaced parallel relationship to one of said side walls for positioning the edge of an envelope upon said bottom panel, and a second ridge homogeneously extending upwardly from said bottom panel in spaced parallel relationship to said front wall defining a coin receiving slot with said front wall, the exterior of said bottom panel and side walls being free of protuberances.

2. In a mail box tray as in claim 1, said first and second ridges comprising partitions of a vertical dimension less than that of said front wall, said first ridge intersecting said front wall and said second ridge intersecting said first ridge.

3. In a mail box tray as in claim 1, said side walls uniformly decreasing in vertical dimension from said rear wall to said front wall throughout their length.

* * * * *